United States Patent [19]

Schumacher

[11] Patent Number: 5,033,643

[45] Date of Patent: Jul. 23, 1991

[54] METHOD AND CONTAINER FOR DISPENSING A FILLING MATERIAL

[75] Inventor: Clemens Schumacher, Sundern, Fed. Rep. of Germany

[73] Assignee: Robert Finke GmbH & Co. KG, Lenhausen, Fed. Rep. of Germany

[21] Appl. No.: 477,501

[22] Filed: Feb. 9, 1990

[30] Foreign Application Priority Data

Feb. 9, 1989 [DE] Fed. Rep. of Germany ..... 3903793

[51] Int. Cl.[5] ..... B67D 5/08

[52] U.S. Cl. ..... 222/52; 222/485; 222/523; 68/17 R; 68/171; 206/221; 220/254

[58] Field of Search ..... 222/1, 52, 54, 522, 222/523, 225, 500; 206/219, 221, 0.5; 220/254, 367; 141/346, 347, 349

[56] References Cited

U.S. PATENT DOCUMENTS

| | | | |
|---|---|---|---|
| 2,956,709 | 10/1960 | Nison et al. | 222/463 |
| 3,108,722 | 10/1963 | Torongo, Jr. et al. | 222/500 |
| 3,174,647 | 3/1965 | Ludwig | 222/52 |
| 3,180,538 | 4/1965 | Brown et al. | 222/500 |
| 3,215,311 | 11/1965 | Nison et al. | 222/500 |
| 3,399,806 | 9/1968 | Lucas | 222/54 |
| 3,888,391 | 6/1975 | Merz | 222/52 |
| 4,703,872 | 11/1987 | Cornette et al. | 222/158 |
| 4,875,600 | 10/1989 | O'Hoogue et al. | 222/52 |
| 4,942,973 | 7/1990 | Bowie | 222/54 |
| 4,944,165 | 7/1990 | Leebeek et al. | 206/0.5 |
| 4,969,927 | 11/1990 | Schumann et al. | 206/0.5 |

FOREIGN PATENT DOCUMENTS

| | | | |
|---|---|---|---|
| 8801528 | 2/1988 | Fed. Rep. of Germany . | |
| 1375655 | 9/1964 | France | 222/523 |
| 1549292 | 12/1968 | France | 222/523 |

*Primary Examiner*—Michael S. Huppert
*Assistant Examiner*—Kenneth Bomberg
*Attorney, Agent, or Firm*—Antonelli, Terry, Stout & Kraus

[57] ABSTRACT

A method for the dispensing of a filling material, especially a liquid detergent, from a container provided for this purpose into a material to be washed during a mechanical washing process wherein the container with the filling material is subjected to the washing process, filling material being delivered from the container during this process. The provision is made that the dispensing of the filling material from the container is regulated by exertion of a force on the container during the washing process. Furthermore, a container is provided suitable for performing this method.

8 Claims, 4 Drawing Sheets

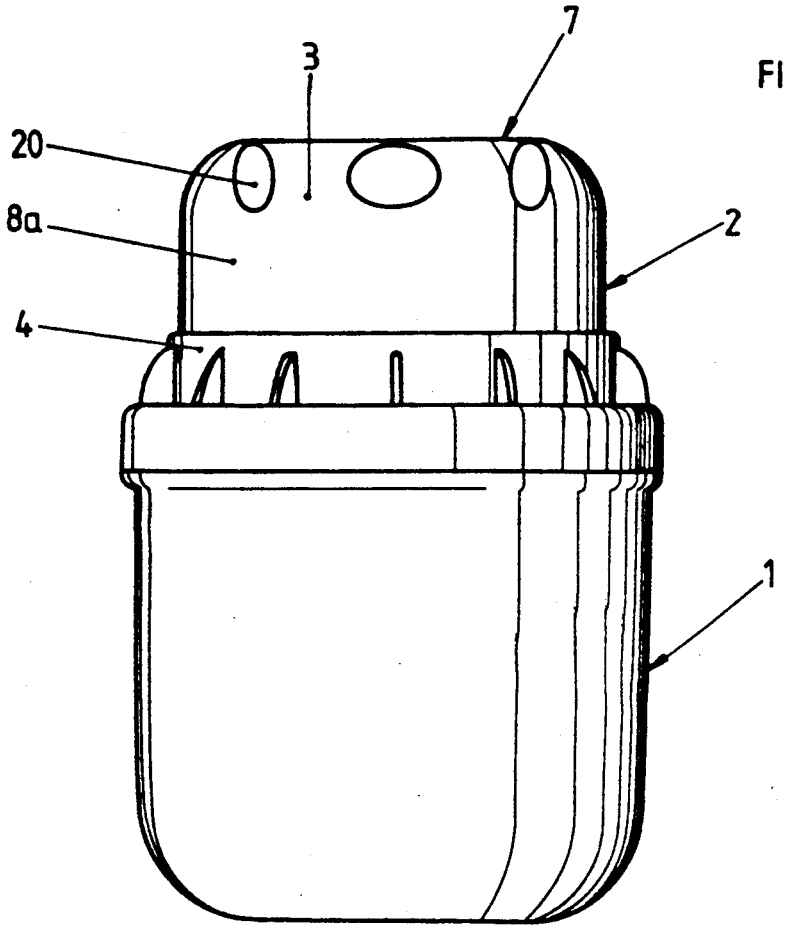
FIG. 1
FIG. 2
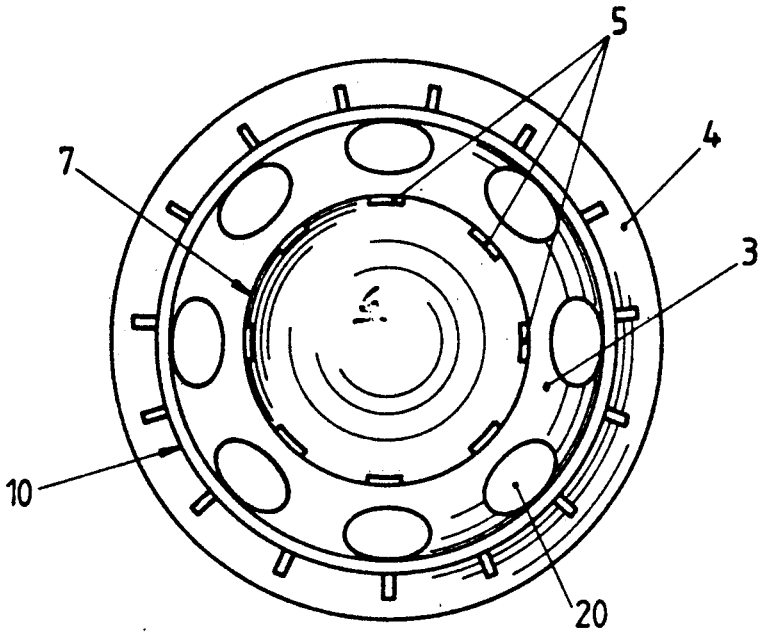

METHOD AND CONTAINER FOR DISPENSING A FILLING MATERIAL

BACKGROUND AND SUMMARY OF THE INVENTION

The present invention relates to a method for the dispensing of a filling material, especially a liquid detergent, from a container provided for this purpose into a material to be washed during a mechanical washing process wherein the container with the filling material is subjected to the washing process, filling material being delivered from the container during this process.

Furthermore, the present invention concerns a container for dispensing filling material, especially a liquid detergent, during a mechanical washing process into the material to be washed wherein at least one delivery opening is provided, as well as at least one control portion which vacates and, respectively, blocks the delivery opening by a sliding action.

A method of the aforementioned type has been known from U.S. Pat. No. 3,399,806. According to this U.S. patent, the dispensing of the filling material is regulated by moisture during the washing step. For this purpose, a diaphragm is arranged over a delivery opening of a container, this diaphragm being dissolved by the moisture, be it that of the filling material or of the washing water, after appropriate protective measures have been eliminated for activating the container, these protective measures preventing premature dissolution or maceration of the aforementioned diaphragm.

Such a procedure is not without problems from the viewpoint of handling technique, in that such a diaphragm shows low mechanical stability. Consequently there is the danger that rupturing of the aforementioned diaphragm will occur during handling of the container even outside of the washing process and accordingly, with the above-mentioned protective measures having been neutralized, the filling material will escape directly to the outside.

Problems are likewise encountered in providing a moisture-sensitive diaphragm regarding the storage of the item, inasmuch as atmospheric humidity and/or moisture diffusing from the filling material to the diaphragm will lead, after a certain time, to softening of such a diaphragm in spite of the protective measure, considering that the effort of sealing the item which can be expended within the framework of a method of the above-mentioned type must not be too extensive.

Another objective of the technique disclosed in this U.S. patent resides in dispensing the filling material after a predetermined time period during which the container is subjected to the washing process. The dissolution time of the aforementioned diaphragm is utilized for this purpose, and the above remarks demonstrate that a time delay that is even merely halfway regulated can hardly be realized, for example due to the previously prevailing, indefinite initial conditions with respect to environmental humidity.

Furthermore, the aforementioned diaphragm, once uncovered, is extremely sensitive during the washing process to spotwise mechanical stresses, and is apt to rupture prior to its planned dissolution time when subjected to point-like stresses by the laundry.

Another method, similar to the above-discussed type, has been known from EP-A-0,152,359. According to this reference, initially opened outlets are provided in a container, i.e. no triggering or activation of the delivery of filling material is realized during the laundering process. However, dispenser means that are already open at the instant of deploying the container have the inherent danger that the filling material, especially the liquid detergent, flows out already before the actual washing process begins and contacts the laundry in high concentration at an undesirably early point in time. This can give rise to spot formation, such as when the washing material is laundry, or the prematurely dispensed filling material can already flow to the drain before it has done its work at all.

It is an object of the present invention to further develop a method and, respectively, a container of the above-mentioned type so that the delivery of filling material during the washing process is regulated without having to provide in this process complicated, sensitive elements specifically for this purpose, such as the sealing diaphragms dissolving under the action of moisture, known from U.S. Pat. No. 3,399,806.

This has been attained, in a method of the kind discussed above, by regulating the delivery of the filling material from the container by the action of force exerted on the container during the washing process.

In this procedure, use is made of the fact that, during the mechanical laundering procedure, forces act on every item subjected to the laundering step, these forces, on account of the mechanical stresses, differing substantially from the forces in a stationary environment. Thereby, a variable has actually been discovered, with the aid of which a discrimination can be made of whether or not the container is involved in the washing process.

In a highly simple manner, at least two parts displaceable relatively to each other by external force application are provided at the container in this arrangement, these parts, during the relative movement, vacating and, respectively, blocking the delivery means. Since usually such a container is subjected to the washing process together with material to be laundered, such as, for example and especially, with laundry, the container is exposed to pressure forces engaging in a more or less random fashion over the time period and thus, even after the beginning of the laundering process, time and again assuming directions causing the parts displaceable relatively to each other to be actually mutually displaced, thus releasing the delivery.

On account of the fact that the regulating force action is counteracted by a predetermined, preferably predeterminable counterforce, the objective is attained that the force effect required for triggering the dispensing step is determined in the manner of a threshold value. For example, considering a washing process for laundry, the effects of the force as soon as the laundry has been wetted down are substantially higher than in case of laundry that is still dry. Due to the fact that, as mentioned above, a counterforce is given or is predeterminable along the lines of a maximally optimal setting of the instant of delivery, it becomes possible to determine the washing process stages which, with corresponding force exertion, are to trigger the delivery.

As mentioned above, the force during the washing process acts on the container with a more or less accidentally oriented direction so that, considering a region of the container, stressing forces occur time and again in a specific direction. Taking this into account, it is possible to make a rough determination of the time delay with which delivery is to be triggered during the washing process, by releasing such delivery once a predetermined amount of work has been performed under the effect of the force, i.e. when a certain displacement path has been traversed.

In order to attain the above-mentioned object, a container according to this invention is furthermore distinguished in that the control part is displaceable by an essentially centrally oriented action of force on the container. A frictional force is employed with preference from a constructional viewpoint as the counterforce along the above lines, by providing that the preferably two, mutually displaceable container parts are shiftable in a frictional fashion.

On account of the fact that the friction force is designed to be adjustable, for example by placing a friction seat under different tension settings or making the parts of different roughness, a determination can be made of the amounts of force to be expended for opening the dispensing aperture, for example in a laundry washing process this being the degree of wetness of the washed laundry.

The invention will be described in greater detail below by way of example with reference to the drawings.

BRIEF DESCRIPTION OF DRAWINGS

FIG. 1 shows a lateral view of the container according to this invention;

FIG. 2 shows a top view of the lid section of a container according to FIG. 1;

DETAILED DESCRIPTION OF DISCLOSED EMBODIMENT

Figure 3:
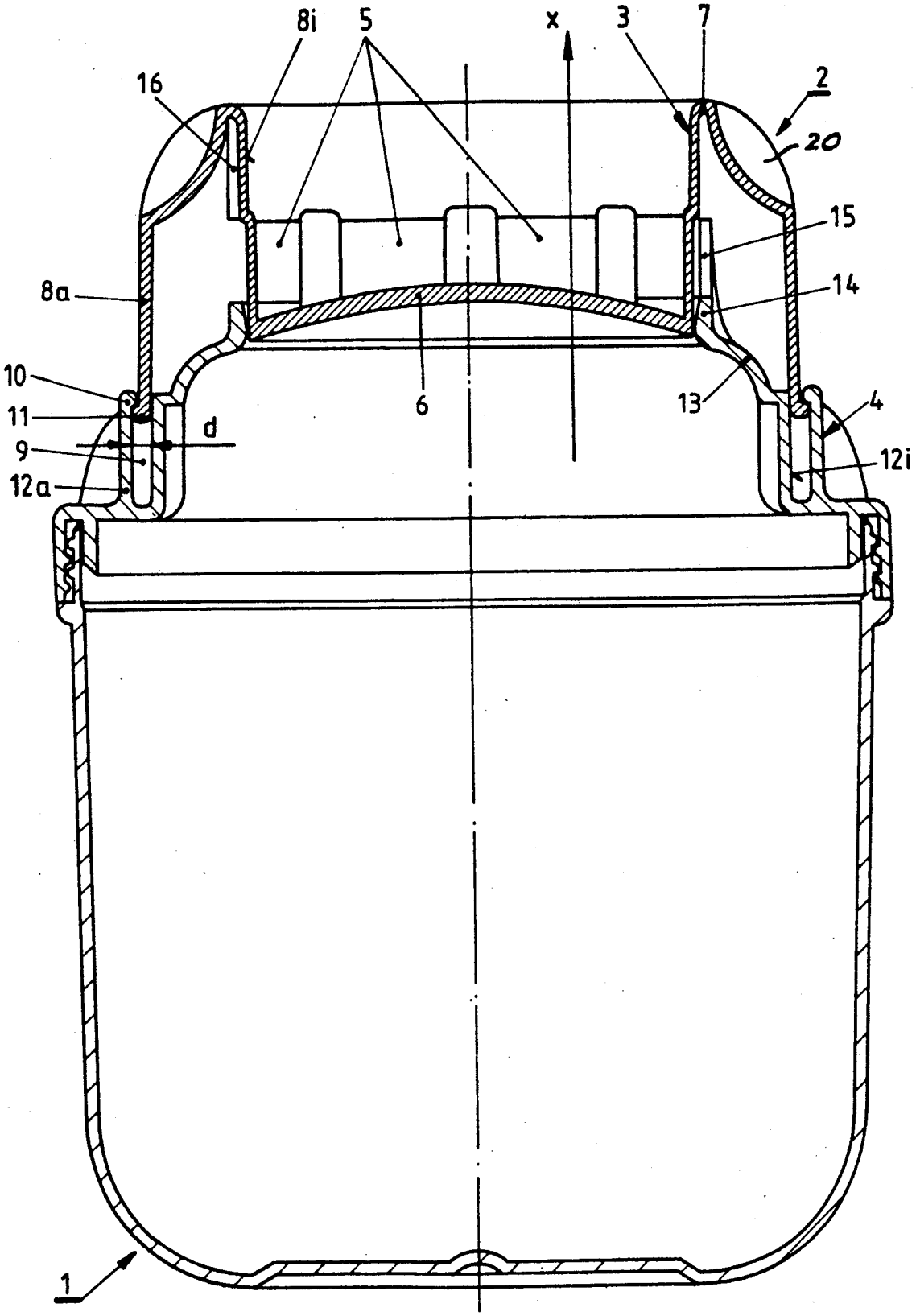
FIG. 3 is a longitudinal section through the container according to FIG. 1 in the closed position.

The container according to this invention, operating pursuant to the method of this invention, comprises a container bottom section 1 and a lid section 2. The lid section 2, threadable onto the bottom section 1, comprises, in turn, a double-walled cup 3, as well as a base portion 4. The inner wall 8*i* of the cup 3 exhibits radial openings 5 disposed above a cup bottom 6, the latter forming the termination of the inner wall 8*i* of the cup 3. The inner wall 8*i* is continued via a cup rim 7 into a downwardly projecting outer wall 8*a* guided at the end zone in an annular channel 9 in the base portion 4 to be axially displaceable. In the relative position of lid section 2 and bottom section 1 illustrated in FIG. 3, wherein the openings 5 are closed, a marginal bead 11 of the outer wall 8*a* in the end zone is in contact with a marginal bead 10 on the outer wall 12*a*, forming the annular channel 9, of the base portion 4 whereby the lid section 2 is secured against additional pulling out and/or detachment. The lid section 2, as mentioned above, can be displaced in a sliding fashion axially to and fro in the directions illustrated by x in FIG. 3 and, respectively, y in FIG. 4. The force $K_{xy}$ required for this purpose is determined at least primarily by the friction of the marginal bead 11 in the channel 9.

The inner wall 12*i* of the annular channel 9 at the base portion 4 continues into a radially inwardly extending annular flange 13, the latter having a sealing lip 14 at the end; this lip contacts the inside of the inner wall 8*i* of the cup 3. In the closed position according to FIG. 3, this sealing lip 14 is approximately located at the level of the cup bottom 6, and thus the openings 5 are above the sealing lip so that passage through these openings 5 from the interior of the container through the central space of the cup 3 is blocked. In contrast thereto, if the cup 3 is shifted into the position according to FIG. 4, then at least an axial segment of the openings 5 comes to lie below the sealing lip 14, and thus this portion of the openings opens up throughflow from the interior of the container into the central space of the cup 3 and thus into the surroundings. In this position of the two container sections 1 and 3, the container can be filled by pouring into the central depression of the cup 3. In this position, the container is also emptied while it is being rocked to and fro by the rotating movements of a washing machine drum During this process, washing water also enters the item and thus a continuous exchange of filling material and washing water takes place.

Figure 4:
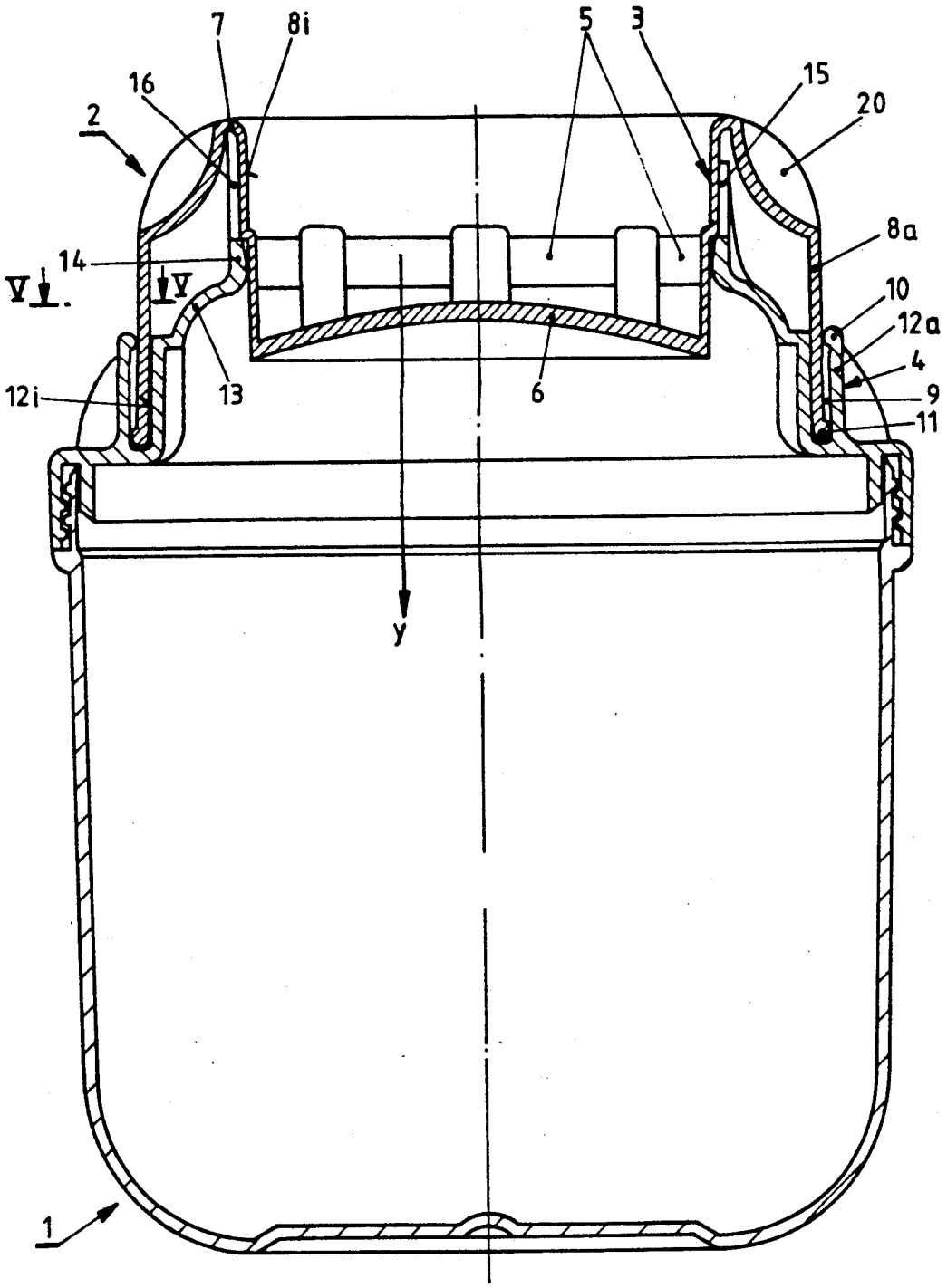
FIG. 4 is a longitudinal section according to FIG. 3 through the container of FIG. 1 in the open position.

As mentioned above, the effect of the force which must act in direction y according to FIG. 4 between the cup 3 and the bottom section 1 of the container in order to bring about an axial displacement of the two sections 1, 3, is determined by the frictional relationships between the outer wall 8*a* of the cup 3 and the bead 10, as well as the walls 12*a*, 12*i* of the channel 9 with the bead 11. These frictional relationships can be initially predetermined in such a way that only specific amounts of force occurring during the laundering process will lead to an opening displacement of the two parts 1, 3, especially that only force effects created by wet laundry will trigger the aforementioned displacement.

Figure 5:
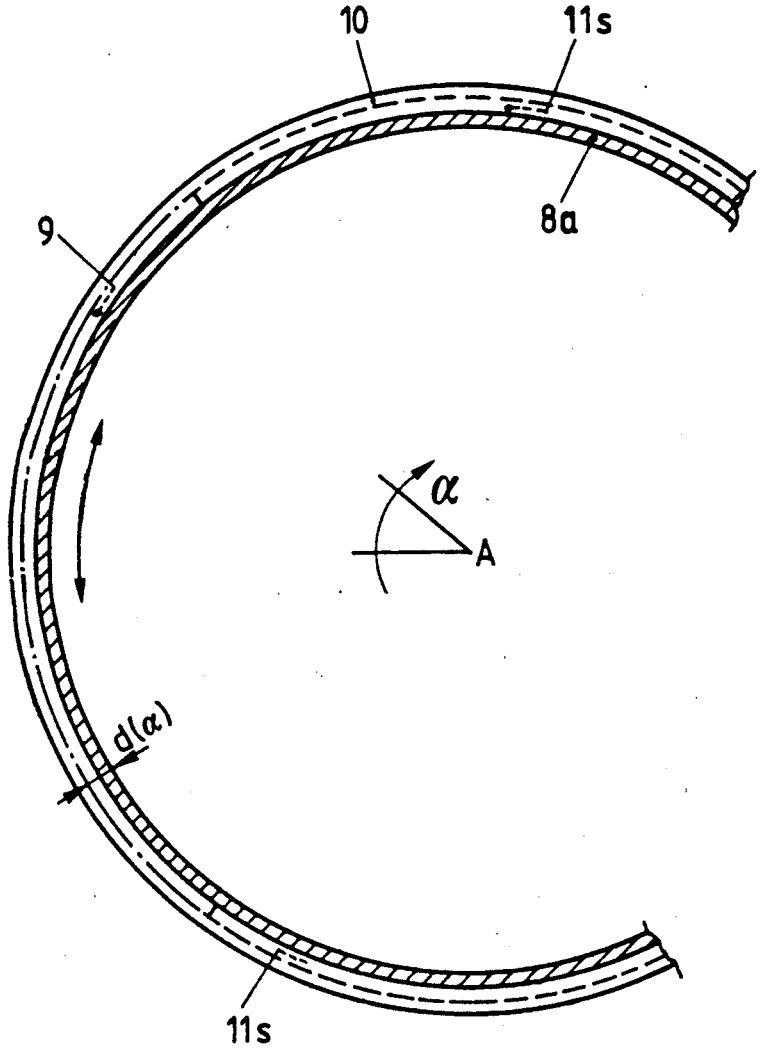
FIG. 5 shows a detailed view of a fragment of a container according to FIG. 4, in a section along line V of FIG. 4, with a structure for adjustment of the force effect necessary for delivery.

In the closed condition of the container according to FIG. 3, the tightness of the container is determined exclusively or at least quite substantially by the seating of the sealing lip 14 on the inner wall 8*i* of the cup 3. For this reason, there is the distinct possibility to provide, according to FIG. 5, the bead 11 concomitantly determining the friction only at predetermined segments 11*s*, rather than over the entire periphery of the outer wall 8*a*. If, now, as shown in FIG. 5, the width d (see also FIG. 3) of the channel 9 is designed to vary with the azimuthal angle or the roughness of the channel walls and/or of the wall 8*a* is azimuthally varied, then, by a corresponding rotation of the cup 3 with respect to the bottom section 1 about the axis A of the container according to FIG. 5, the bead segments 11*s* can be turned into more or less wide regions of the channel 9 whereby the friction relationships can be adjusted Thus, an adjustment can be made of the amounts of force to be exerted during the washing process to bring about the opening movement of the cup 3 with respect to the bottom section 1 of the container In case forces occur which thus are sufficient for overcoming the friction relationships in the channel 9, if necessary also the friction conditions between the sealing lip 14 and the inner wall 8*i* of the cup 3, then the cup 3 is pushed inwards in the direction denoted by y in FIG. 4. This inward insertion takes place only as long as the respective action of the force is in each case actually exerted. In a laundering process wherein, as in a washing machine drum, the force acting on the container subjected to the laundering process occurs in random directions varying with respect to time, the force effects required for displacement thus will not prevail permanently starting with a certain instant but rather will reoccur starting with a certain instant. By predetermining the axial length of the channel 9, i.e. of the displacement path and thus of the work to be performed by the force action, a delay time is thus fixed which determines, starting with the first occurrence of the force effect required for displacement, the approximate length of time until first a partial, then finally a complete opening of the apertures 5 has taken place.

In order to facilitate a return of the container parts from the open position according to FIG. 4 to the closed position according to FIG. 3, control bevel surfaces are preferably provided basically between section 1 and the cup 3 in such a way that, starting with the position according to FIG. 4, the cup 3 can be rotated about the axis A of the container, the superposing of the control bevels driving the parts 3 and 1 apart. Especially in case one's hands are wet, the execution of a turning motion is substantially simpler than the direct execution of a pulling-out motion. For this purpose, a beveled surface 16 is, for example, worked into the inside of the inner wall 8*i* at its upper zone adjoining the cup rim 7; this beveled surface, with a corresponding rotation of the cup 3 about the container axis A, is brought into engagement with a beveled surface 15 at the base member 4, namely only in case the two displaceable container parts 3, 1 are in the position illustrated in FIG. 4. By turning the two control surfaces 15 and 16 into superposed position, the two parts 3 and 4 and thus 3 and 1 are shifted apart.

Figure 6:
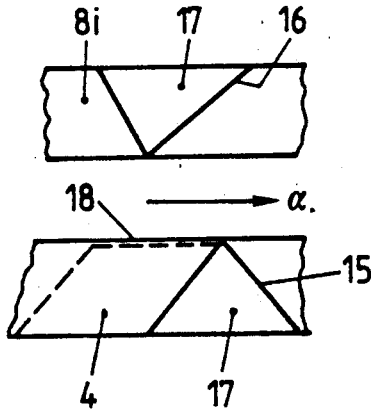
FIG. 6 is a schematic view of control bevels to facilitate handling of the container.

FIG. 6 illustrates schematically such control bevels 15 and 16 at the base portion 4 and, respectively, at the cup 3. If these control bevels, corresponding to projecting control surface elements 17, are designed to be trapezoidal, as shown in dashed lines, then the possibility is additionally obtained of locking the two parts 3 and 4 against engagement by a corresponding turning of the cup 3 in such a way that the control surface element 17 pertaining thereto comes to lie on the topside 18 of the trapezoidal control element at the part 4.

In order to provide improved engagement at the cup 3, grasping dimples 20 are worked into the item. By turning the cup 3 while seizing these grasping dimples 20 in the position illustrated in FIG. 4, the bevel faces 15 and 16, as mentioned above, come into superposed engagement (FIG. 6) whereby the cup 3 is pushed outwards (in direction x).

All of the novel features mentioned in the specification and illustrated in the drawings are essential to the invention, even though they may not have been expressly set forth in the claims.

I claim:

1. A container for dispensing a detergent into material to be washed during a machine washing process, comprising:

two container portions which are movably linked to each other to be movable in a substantially telescopic manner with respect to each other in direction of an axis of said container;

a first of said two container portions defining a receptacle for containing detergent, said first portion having an opening in a plane which is arranged substantially perpendicular to said axis and said first portion having a sealing rim around said opening;

a second of said two container portions including a cup part having an axially open upper end a cup bottom and a cup wall arranged around said cup bottom substantially perpendicular to said cup bottom; said cup part being mounted on said container so as to be movable within said opening of said first container portion;

at least one dispenser opening arranged in said cup wall;

said dispenser opening in said cup wall being moved at least partially past said sealing rim as said two container portions are moved towards each other so that said dispenser opening at least partially enters into said receptacle of said first container portion to allow dispensing of said detergent out of said receptacle through said dispenser opening in said cup part and whereas said dispenser opening is sealed from the detergent in said receptacle by said sealing rim as said two container portions are telescopically separated from each other.

2. The container of claim 1, wherein said cup part is double walled with an outer wall thereof movably linked to said first container portion in said substantially telescopic manner.

3. The container of claim 2, wherein said first container portion comprises a ring-shaped channel arranged substantially coaxially to said axis, said outer wall of said cup portion being slidably movable within said ring channel in said axial direction.

4. The container of claim 3, wherein said channel and said outer wall located slidably movable within said channel comprise sections of at least two different frictional engagement being said channel and said outer wall, said frictional engagement being selectable by angularly displacing said outer wall within said ring channel.

5. The container of claim 3, wherein said outer wall and said ring channel comprise respective abutments which engage one another when said two container portions are telescopically separated from one another a predetermined amount to prevent pulling out of said outer wall from said ring channel.

6. The container of claim 3, wherein an inner wall portion of said ring channel of the first container portion is linked to said sealing rim.

7. The container of claim 1, further comprising respective control surfaces at said two container portions, said control surfaces providing for a telescopic movement of said two container portions from each other as said two container portions are twisted relative to each other.

8. The container of claim 1, wherein said first container portion comprises a bottom section and a base portion of a lid which are releasably connected to one another, said base portion of the lid having said sealing rim formed thereon.

* * * * *